US010894411B2

(12) United States Patent
Levy et al.

(10) Patent No.: US 10,894,411 B2
(45) Date of Patent: Jan. 19, 2021

(54) CAP AND APPLICATION DEVICES STABILIZING INK IN NOZZLES OF INKJET PRINTHEADS

(71) Applicant: Xerox Corporation, Norwalk, CT (US)

(72) Inventors: Michael J. Levy, Webster, NY (US); Seemit Praharaj, Webster, NY (US); Paul J. McConville, Webster, NY (US); Jason M. LeFevre, Penfield, NY (US); Linn C. Hoover, Webster, NY (US); Chu-heng Liu, Penfield, NY (US); David A. VanKouwenberg, Avon, NY (US); Douglas K. Herrmann, Webster, NY (US); John T. Newell, Fairport, NY (US); Richard A. Campbell, Rochester, NY (US); Ali R. Dergham, Fairport, NY (US); Glenn D. Batchelor, Fairport, NY (US); Robert A. Clark, Williamson, NY (US); Senthil Sivaraman, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/272,048

(22) Filed: Feb. 11, 2019

(65) Prior Publication Data

US 2020/0254761 A1 Aug. 13, 2020

(51) Int. Cl.

| | |
|---|---|
| ***B41J 2/165*** | (2006.01) |
| *B41J 2/01* | (2006.01) |
| *B41J 2/125* | (2006.01) |

(52) U.S. Cl.

CPC ..... *B41J 2/16505* (2013.01); *B41J 2/165* (2013.01); *B41J 2/16523* (2013.01);
(Continued)

(58) Field of Classification Search

CPC ..... B41J 2/16505; B41J 2/16523; B41J 2/16552; B41J 2/01; B41J 2/125; B41J 2/165; B41J 2/16538; B41J 2/16508

See application file for complete search history.

(56) References Cited

U.S. PATENT DOCUMENTS

| | | | |
|---|---|---|---|
| 4,296,418 | A | 10/1981 | Yamazaki et al. |
| 4,364,065 | A | 12/1982 | Yamamori |

(Continued)

FOREIGN PATENT DOCUMENTS

| | | | |
|---|---|---|---|
| DE | 102011002727 | A1 | 7/2012 |
| EP | 1 827 839 | B1 | 2/2009 |

(Continued)

OTHER PUBLICATIONS

Kwon et al., "Measurement of Inkjet First-Drop Behavior Using a High-Speed Camera," Review of Scientific Instruments; vol. 87, Issue 3, 2016, AIP Publishing, pp. 1-11.

*Primary Examiner* — Yaovi M Ameh
(74) *Attorney, Agent, or Firm* — Gibb & Riley, LLC

(57) ABSTRACT

A cap is positioned to contact a printhead when the printhead is not ejecting liquid ink. The cap and the printhead create a sealed space adjacent printhead nozzles when contacting each other. A flexible blade is positioned to contact the printhead when the printhead is not in contact with the cap. The flexible blade is adapted to fold over to spread a liquid solution on the nozzles in a first direction, and the flexible blade is adapted to remove excess amounts of the liquid solution from the nozzles in a second direction. A humidifier is connected to the cap and adapted to supply a moisture form of the liquid solution to the sealed space. A moisture sensor is connected to the cap. The humidifier is adapted to vary supply of the moisture to the sealed space based on the amount of moisture detected by the moisture sensor.

12 Claims, 13 Drawing Sheets

(52) U.S. Cl.
CPC ..... *B41J 2/16552* (2013.01); *B41J 2/01* (2013.01); *B41J 2/125* (2013.01); *B41J 2/16508* (2013.01); *B41J 2/16538* (2013.01)

(56) References Cited

U.S. PATENT DOCUMENTS

| | | | |
|---|---|---|---|
| 4,571,601 | A | 2/1986 | Teshima |
| 4,746,938 | A | 5/1988 | Yamamori et al. |
| 4,947,187 | A | 8/1990 | Iwagami |
| 5,300,958 | A | 4/1994 | Burke et al. |
| 5,394,178 | A | 2/1995 | Grange |
| 5,412,411 | A | 5/1995 | Anderson |
| 5,635,965 | A | 6/1997 | Purwins et al. |
| 5,663,751 | A | 9/1997 | Holbrook |
| 5,670,997 | A | 9/1997 | Sugimoto et al. |
| 5,726,692 | A | 3/1998 | Yamaguchi et al. |
| 5,936,647 | A | 8/1999 | Rhodes et al. |
| 5,949,448 | A | 9/1999 | Man et al. |
| 5,980,622 | A | 11/1999 | Byers |
| 6,106,098 | A | 8/2000 | Nakamura et al. |
| 6,135,585 | A | 10/2000 | Johnson et al. |
| 6,508,533 | B2 | 1/2003 | Tsujimoto et al. |
| 6,578,947 | B1 | 6/2003 | Suwabe et al. |
| 6,726,304 | B2 | 4/2004 | Fassler et al. |
| 7,156,514 | B2 | 1/2007 | Rosa |
| 7,753,475 | B2 | 7/2010 | Berry et al. |
| 7,810,899 | B2 | 10/2010 | Usui et al. |
| 7,992,986 | B2 | 8/2011 | Snyder et al. |
| 8,592,503 | B2 | 11/2013 | Bogale et al. |
| 2001/0026299 | A1 | 10/2001 | Tsujimoto et al. |
| 2003/0227505 | A1 | 12/2003 | Tanaka et al. |
| 2003/0231222 | A1 | 12/2003 | Jefferson et al. |
| 2004/0183879 | A1 | 9/2004 | Nakazawa |
| 2006/0119645 | A1 | 6/2006 | Berry et al. |
| 2006/0164460 | A1 | 7/2006 | Uwagaki et al. |
| 2006/0274110 | A1* | 12/2006 | Kang ..... B41J 2/16552 347/33 |
| 2007/0046721 | A1 | 3/2007 | Miyazawa |
| 2007/0076045 | A1 | 4/2007 | James et al. |
| 2007/0085875 | A1 | 4/2007 | Shimazaki et al. |
| 2007/0252863 | A1 | 11/2007 | Sun et al. |
| 2007/0263026 | A1 | 11/2007 | Shang et al. |
| 2008/0018677 | A1 | 1/2008 | White et al. |
| 2008/0024532 | A1 | 1/2008 | Kim |
| 2008/0204501 | A1 | 8/2008 | Kurita et al. |
| 2009/0174748 | A1 | 7/2009 | Balcan et al. |
| 2009/0237424 | A1 | 9/2009 | Martin et al. |
| 2010/0073445 | A1 | 3/2010 | Silverbrook et al. |
| 2011/0080443 | A1 | 4/2011 | Terame |
| 2012/0162311 | A1* | 6/2012 | Taira ..... B41J 2/16508 347/30 |
| 2013/0215189 | A1 | 8/2013 | Justice et al. |
| 2014/0253633 | A1* | 9/2014 | Kobayashi ..... B41J 2/16535 347/33 |
| 2017/0072720 | A1 | 3/2017 | Yamagishi |
| 2017/0203573 | A1 | 7/2017 | Hiramoto |
| 2018/0079217 | A1 | 3/2018 | Hiratsuka et al. |
| 2018/0244048 | A1* | 8/2018 | Ito ..... B41J 11/0095 |
| 2018/0311986 | A1* | 11/2018 | Moriyama ..... B41M 5/0064 |
| 2020/0180853 | A1 | 6/2020 | Henry et al. |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008026417 | A1 | 3/2008 |

* cited by examiner

CAP AND APPLICATION DEVICES STABILIZING INK IN NOZZLES OF INKJET PRINTHEADS

BACKGROUND

Systems and methods herein generally relate to ink jet printers and more particularly to cap and application devices that stabilize ink in nozzles of inkjet printheads.

Inkjet printers eject drops of liquid marking material (e.g., ink) from nozzles or "jets" of printheads in patterns to perform printing. Nozzles of such inkjet printheads routinely clog when such are unused for extended periods, for example when an inkjet printer does not print for an extended period, or when certain colors or nozzles go unused for an extended period. This can result in nozzles that do not eject any ink, or that only eject a significantly reduced drop mass.

Additionally, certain colors (e.g., magenta, etc.) are more susceptible to clogging relative to other colors, because certain color inks dry faster than other color inks, which causes the ink to dry in the nozzles of the printhead during extended inactivity. Such nozzle clogging issues can be mitigated, but not avoided, by purge and cleaning cycles.

SUMMARY

In order to address such issues, exemplary apparatuses herein include, among other components, a printhead that includes nozzles that are adapted to eject liquid ink, and a cap positioned to contact the printhead when the printhead is not ejecting the liquid ink. The cap and the printhead create a sealed space adjacent the nozzles when contacting each other.

Additionally, a humidifier is connected to the cap and is adapted to supply a mist form of a liquid to the sealed space while avoiding spraying the mist directly on the nozzles. For example, the humidifier can be an atomizer adapted to form fine droplets of the mist in the sealed space. A reservoir is connected to the humidifier and is adapted to supply the liquid solution to the humidifier, and the cap can include a drain adapted to remove condensation of the mist from the sealed space (which can potentially be connected back to the reservoir).

Also, a moisture sensor can be connected to the cap. The moisture sensor is adapted to detect the amount of mist in the sealed space, and the humidifier is adapted to vary the supply of the mist to the sealed space based on the amount of mist detected by the moisture sensor.

In one example, a controller can be incorporated into, or be operatively connected to, the moisture sensor and/or the humidifier, and the controller can be adapted to control the humidifier to vary the supply of the mist to the sealed space based on the amount of mist detected by the moisture sensor. In another example, the controller can be adapted to control the humidifier to: supply different amounts of the mist to different color printheads; supply the mist to the sealed space only after an idle time period (during which the nozzles do not eject the liquid ink) has expired; etc.

These structures can also include a flexible blade positioned to contact the printhead when the printhead is not in contact with the cap. The flexible blade is adapted to fold over to spread a liquid solution on the nozzles in a first direction, and the flexible blade is adapted to remove excess amounts of the liquid solution from the nozzles in a second direction.

Such structures are provided to wipe the faceplate of the printhead with a cleaning solution, which allows the negative head pressure that already exists in the nozzles to suck the cleaning solution into the nozzles. The cleaning fluid used can be any commonly available cleaning fluid that has a low vapor pressure that will allow the cleaning fluid to stay in the nozzles until it is purged away. While the cleaning fluid remains in the nozzles, it can re-solubilize any dried ink that has previously accumulated in the nozzles, thereby not only preventing ink from drying, but also dissolving any previous ink that has dried. Therefore, such structures keep ink from drying in the nozzles and remove dried ink that has previously accumulated in the nozzles.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
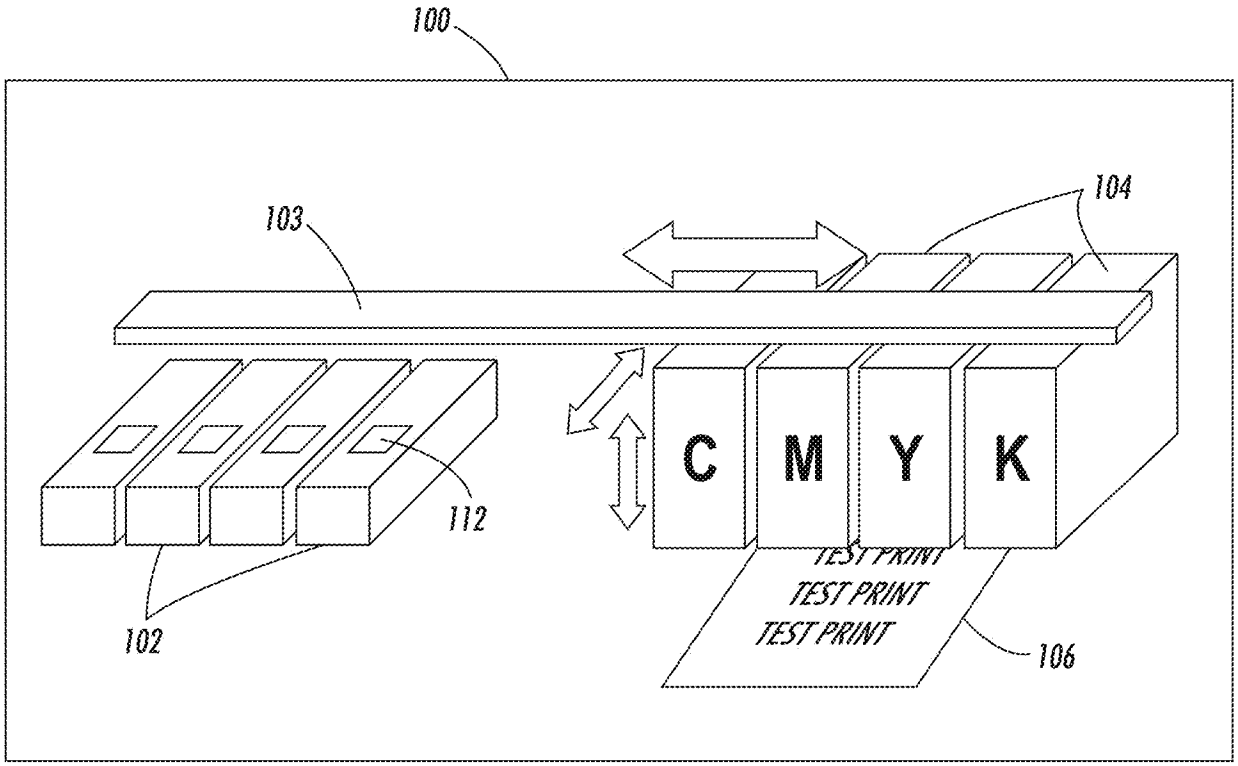
FIGS. 1 and 2 are perspective/exploded conceptual diagrams illustrating inkjet print cartridges and cartridge resting locations of structures herein.

As mentioned above, nozzles of inkjet printheads routinely clog when such are unused for extended periods, and purge and cleaning cycles are not completely effective at preventing clogs. In view of such issues, apparatuses herein include cap and/or solution application devices that stabilize ink in nozzles of inkjet printheads.

More specifically, some structures herein include cap devices that cover printheads when not in use, and the cap devices create a sealed space around the nozzles. Such structures also include a sprayer that provides a gentle mist into the sealed space created by the printhead caps. The increased moisture and humidity resulting from the mist prevents the ink from drying and keeps the nozzles clear and open (preventing the nozzles from clogging). In some examples, the mist can be water or the same purging/cleaning fluid that is currently used for printhead flushing.

Further, such devices can include a sensor attached to the cap (e.g., humidity or moisture sensor) to measure the moisture content in the sealed space created by the cap. Feedback from the sensor can be provided to the sprayer to keep the moisture level within the sealed space constant. Additionally, the cap can include a drain to remove any excess liquid (e.g., water, purge fluid, ink, etc.).

These structures are flexible and spray cycles (e.g., timing and volume/content of moisture) are tailored to be printhead specific, ink specific, color specific, print bar specific, etc., and such are regulated/held constant by the moisture sensor feedback to enable complete automation and control. The misting system can be disabled when the print heads are uncapped. To reduce cost/complexity, all fluids can be supplied from a single supply reservoir so that the same reservoir is used for misting, cleaning, wiping equipment, etc.

Additional structures are included outside the cap to deposit cleaning solution on the print head faceplate, and to cause the cleaning fluid to be drawn into the ends of the nozzles to prevent ink drying and the associated jet clogging. These structures can, for example, include a soft roll-over blade (urethane, silicone, etc.) with cleaning solution supplied to the blade print-head interface. In other embodiments, a cleaning solution impregnated foam roll is included to coat the printhead faceplate and a cleaning blade is included to wipe off any excess cleaning fluid. Another embodiment includes a sprayer that is positioned to spray a mist of cleaning fluid directly on the printhead face, where again the cleaning blade is included to wipe off any excess cleaning fluid.

Such structures are provided to wipe the faceplate of an aqueous print-head with a cleaning solution, which allows the negative head pressure (e.g., approximately 2 inches of water) that already exists in the nozzles to suck the cleaning solution into the nozzles. The cleaning fluid used can be any commonly available cleaning fluid that has a low vapor pressure that will allow the cleaning fluid to stay in the nozzles until it is purged away. While the cleaning fluid remains in the nozzles, it can re-solubilize any dried ink that has previously accumulated in the nozzles, thereby not only preventing ink from drying, but also dissolving any previous ink that has dried. Therefore, such structures keep ink from drying in the nozzles and remove dried ink that has previously accumulated in the nozzles.

Figure 2:
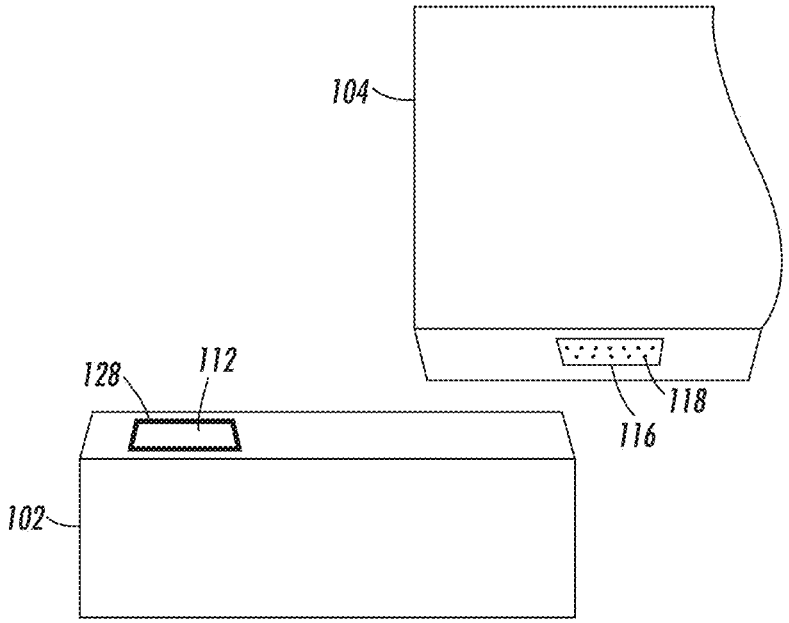

FIGS. 1 and 2 are perspective/exploded conceptual diagrams illustrating some components of an inkjet printing engine 100 that includes inkjet print cartridges 104 and cartridge resting structures 102. One or both of the cartridge resting structures 102 and the inkjet print cartridges 104 are movable along, for example, an actuator/track structure 103. In one example, the inkjet printer cartridges 104 are moved by the actuator/track structure 103 into a printing location to print markings on a sheet of print media 106. When not printing, the inkjet print cartridges 104 move to a "parked," "resting," or "home" position where they connect to a cap 112 of the cartridge resting structures 102. Note, as shown by the block arrows in FIG. 1, the actuator/track structure 103 can move the inkjet print cartridges 104 in many different directions.

The inkjet print cartridges 104 remain connected to the cartridge resting structures 102 unless the inkjet printing engine 100 is in the process of using the inkjet print cartridges 104 for printing. When printing markings on the sheet of print media 106, the ink jet printers 100 eject drops (droplets) of liquid marking material (e.g., ink, etc.) from nozzles 118 (jets) of inkjet printheads 116 in patterns to perform the printing on the print media 106. After printing, the inkjet print cartridges 104 again return to the cartridge resting structures 102.

Again, the nozzles 118 of such inkjet printheads routinely clog when such are unused for extended periods. In order to address such issues, apparatuses herein include the cap 112 as part of the cartridge resting structures 102. The cap 112 is positioned to contact (connect to or join with) the printhead 116 when the printhead 116 is not ejecting the liquid ink. The cap 112 includes a seal 128 so that the cap 112 and the printhead 116 create a sealed space 114 adjacent the nozzles 118 when contacting or connected to each other (e.g., when the printhead 116 is parked on or resting on the cap 112 in between printing operations).

Figure 3:
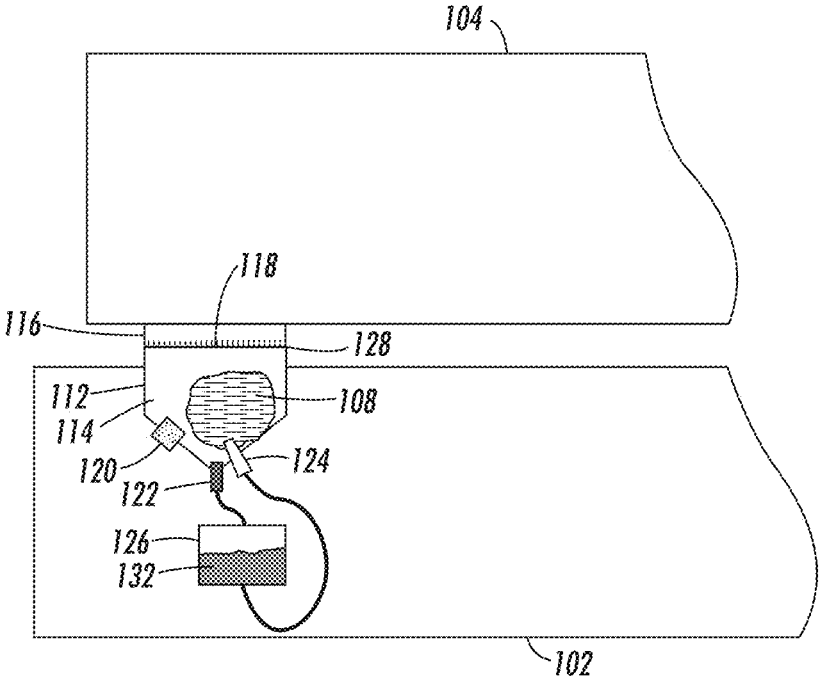
FIG. 3 is a cross-sectional conceptual diagram illustrating an inkjet print cartridge and a cartridge resting location of structures herein.
Figure 4:
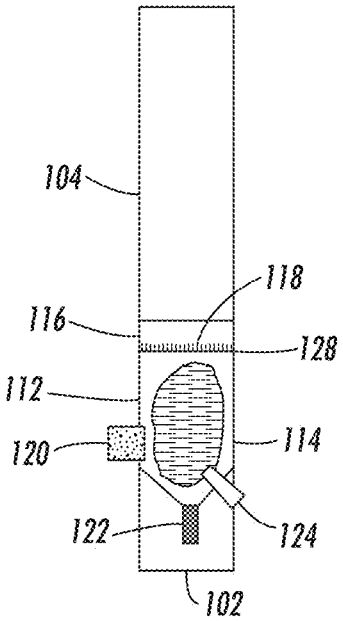
FIG. 4 is an end-view conceptual diagram illustrating an inkjet print cartridge and a cartridge resting location of structures herein.

The sealed space 114 can be more easily seen in the cross-sectional and end views in FIGS. 3 and 4, which show one of the inkjet print cartridges 104 connected to a cartridge resting structure 102. As can also be seen in FIGS. 3 and 4, a humidifier 124 is connected to the cap 112 and is adapted to supply moisture 108 (e.g., a mist, fog, vapor, etc., form of a liquid 132) to the sealed space 114. The liquid 132 that is misted or vaporized to form the moisture 108 can be any conventional cleaning solution, water, or any other liquid 132 that is compatible with the ink and can keep the ink from drying.

The humidifier 124 can be any of a number of devices that can increase the humidity/moisture level within the sealed space 114. For example, the humidifier 124 can be an atomizer or sprayer that forms fine droplets of the mist 108, a fogger that forms a fog 108 in the sealed space 114, a vaporizer that forms a vapor 108 in the sealed space 114, a heated evaporator that evaporates the liquid 132 to result in increased humidity levels 108 in the sealed space 114, etc. Note that while the humidifier 124 is adapted to supply a mist, fog, vapor, etc., 108, the humidifier 124 avoids spraying the liquid 132 directly on the nozzles 118.

A reservoir 126, that can be positioned in the cartridge resting structure 102, is connected to the humidifier 124 and is adapted to maintain and supply the liquid 132 to the humidifier 124. Additionally, the cap 112 can include a drain 122 that is positioned to remove condensation of the mist 108 from the sealed space 114. The drain can drain to a waste container (which can be represented by item 126) or can potentially be connected back to the reservoir (alternatively represented by item 126) to resupply the drained liquid 132 to the humidifier 124.

Also, a moisture (e.g., humidity) sensor 120 can be operatively (meaning directly or indirectly) connected to the cap 112. The moisture sensor 120 is adapted to detect the moisture or humidity level (e.g., the amount of moisture 108) in the sealed space 114. The humidifier 124 is operatively connected to the moisture sensor 120 and the humidifier 124 receives signals from the moisture sensor 120 that vary (change) as the moisture level varies (changes). The humidifier 124 releases more moisture 108 (e.g., mist, fog, vapor, etc.) into the sealed space 114 as the moisture level decreases (as determined by the moisture sensor 120) and releases less moisture 108 (e.g., mist, fog, vapor, etc.) into the sealed space 114 as the moisture level increases (as determined by the moisture sensor 120) to keep the moisture level in the sealed space 114 constant (or within a range of moisture/humidity values). Therefore, the humidifier 124 is adapted to vary the supply of the moisture 108 to the sealed space 114 based on the amount of moisture 108 detected by the moisture sensor 120.

In one example, a controller can be operatively connected to, or incorporated into, the moisture sensor 120 and/or the humidifier 124 (and elements 120 and/or 124 in the drawings are intended to also illustrate such a controller) and such a controller can be adapted to control the humidifier 124 to vary the supply of the moisture 108 to the sealed space 114 based on the amount of moisture 108 detected by the moisture sensor 120.

As noted above, the moisture/humidity level in the sealed space 114 can be maintained at different levels for different printheads, different inks, different colors, different print bars, etc. Therefore, the controller can be adapted to control the humidifier 124 to: supply different amounts of the moisture 108 to different color printheads 116; supply different amounts of the moisture 108 to different types of printheads 116; supply the moisture 108 to the sealed space 114 only after an idle time period (during which the nozzles 118 do not eject the liquid ink) has expired; etc., and the idle time can similarly be different levels for different printheads, different inks, different colors, different print bars, etc.

Figure 5:
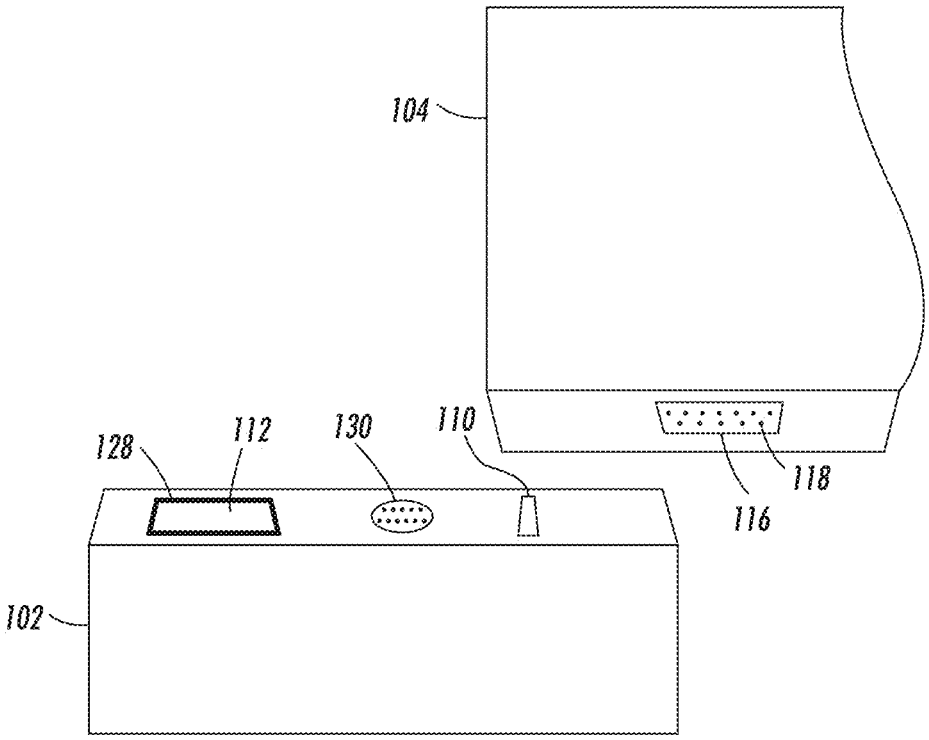
FIG. 5 is a perspective/exploded conceptual diagram illustrating an inkjet print cartridge and cartridge resting location of structures herein.
Figure 6:
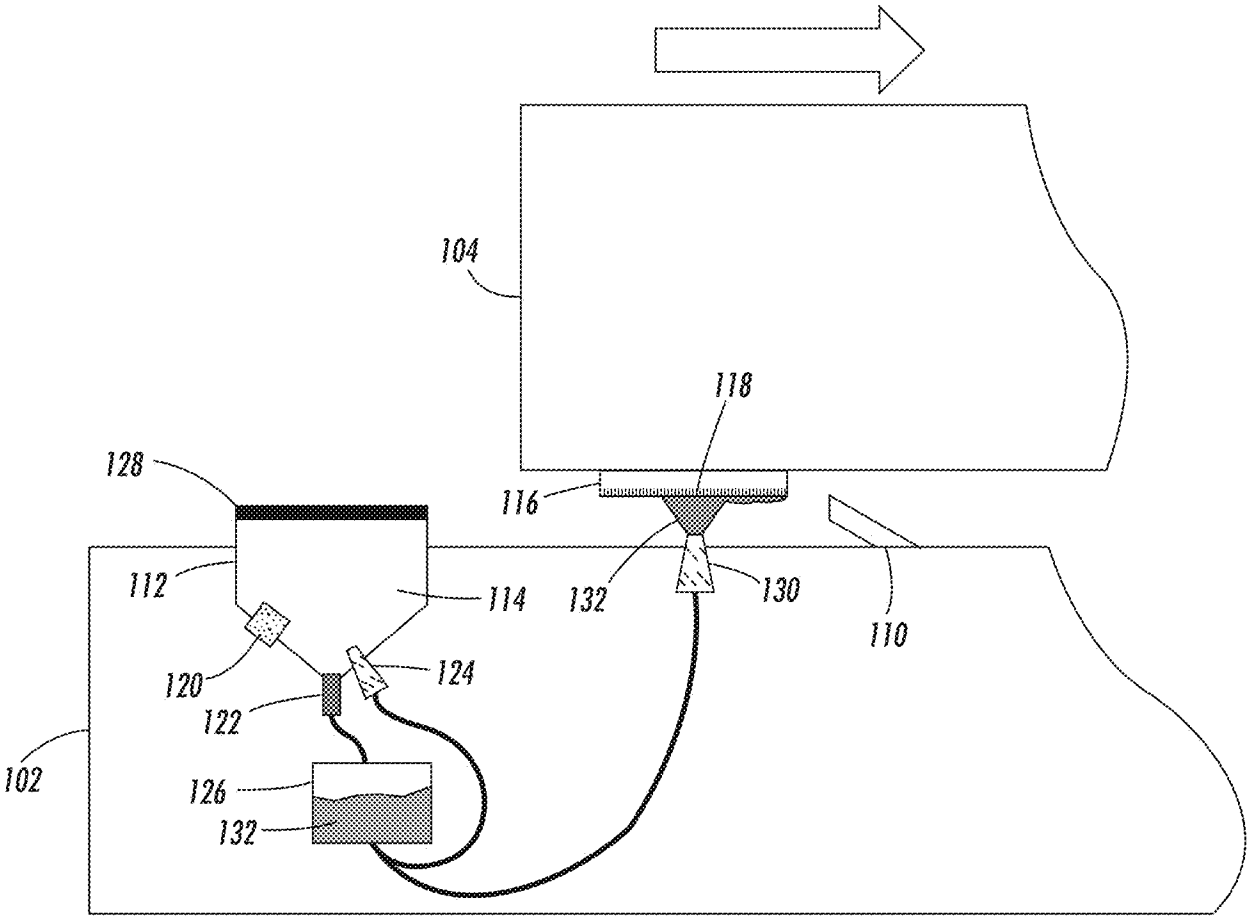
FIGS. 6-12 are cross-sectional conceptual diagrams illustrating an inkjet print cartridge and a cartridge resting location of structures herein.
Figure 7:
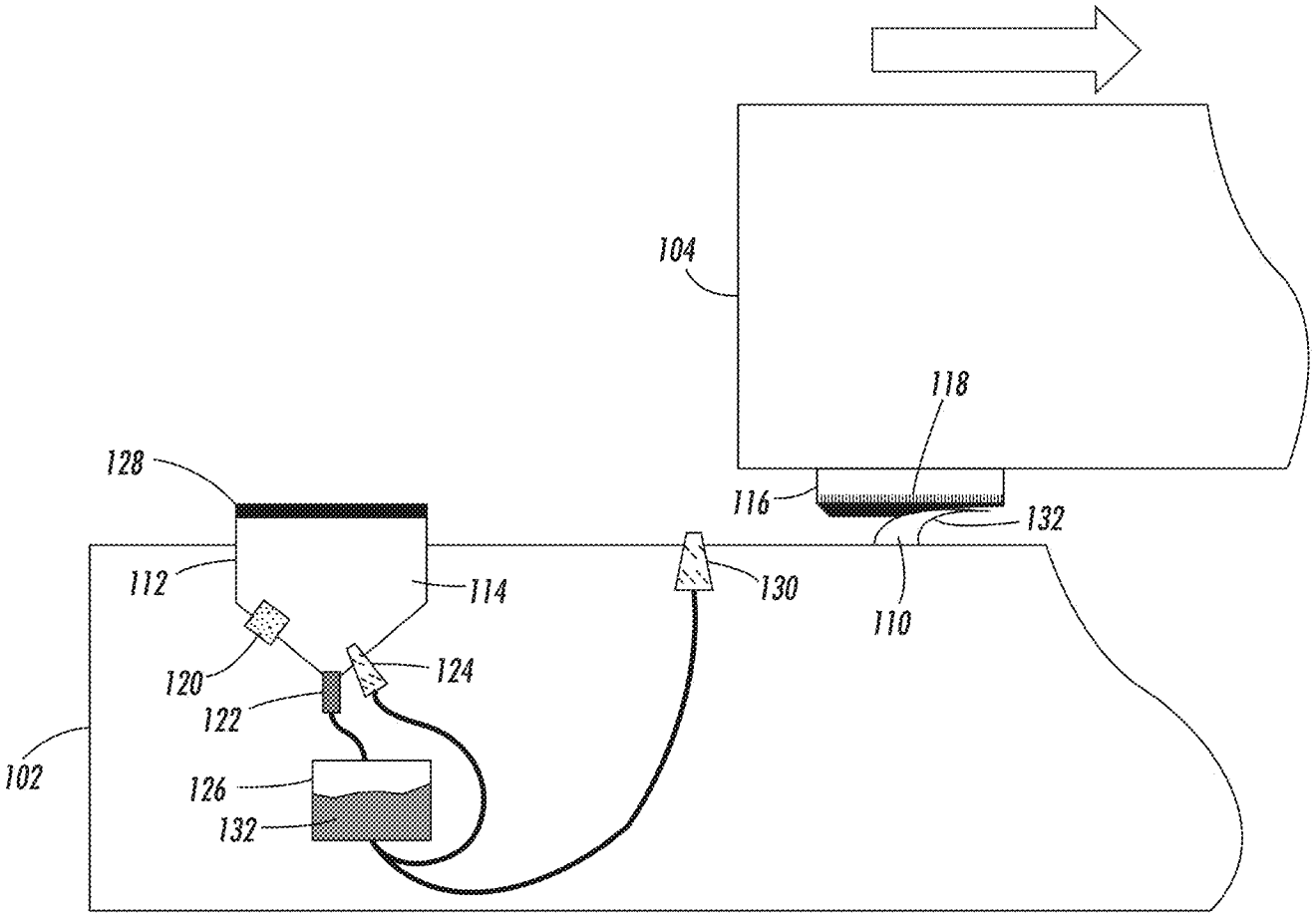

As shown in FIGS. 5-8, these structures can also include cleaning solvent application systems, one of which can use a flexible blade 110 positioned to contact the printhead 116 when the printhead 116 is moving toward the cap 112 (when the printhead 116 is not in contact with the cap 112). FIG. 5 shows such a structure in perspective/exploded view. FIG. 6 shows the same in cross-sectional view and both drawings illustrate an applicator 130 (e.g., sprayer, etc.) that sprays/applies a liquid 132 (e.g., any form of printhead cleaning liquid) on to nozzles 118 of the printhead 116. The applicator 130 can be supplied the liquid 132 from the reservoir 126 that is discussed above or can receive the cleaning liquid 132 from a different source (see discussion of FIGS. 11 and 12 below).

The block arrow in FIG. 6 illustrates that the inkjet print cartridge 104 can move relative to the cartridge resting structure 102 (e.g., using the actuator/track structure 103 discussed above) which causes the printhead 116 to move toward the flexible blade 110 during and after receiving the liquid 132 from the applicator 130. As shown in cross-sectional view in FIG. 7, as the printhead 116 moves to and over the flexible blade 110 (in a "first" direction) the printhead 116 contacts the flexible blade 110 and the flexible blade 110 is adapted to fold over to spread the liquid 132 evenly on the nozzles 118.

Figure 8:
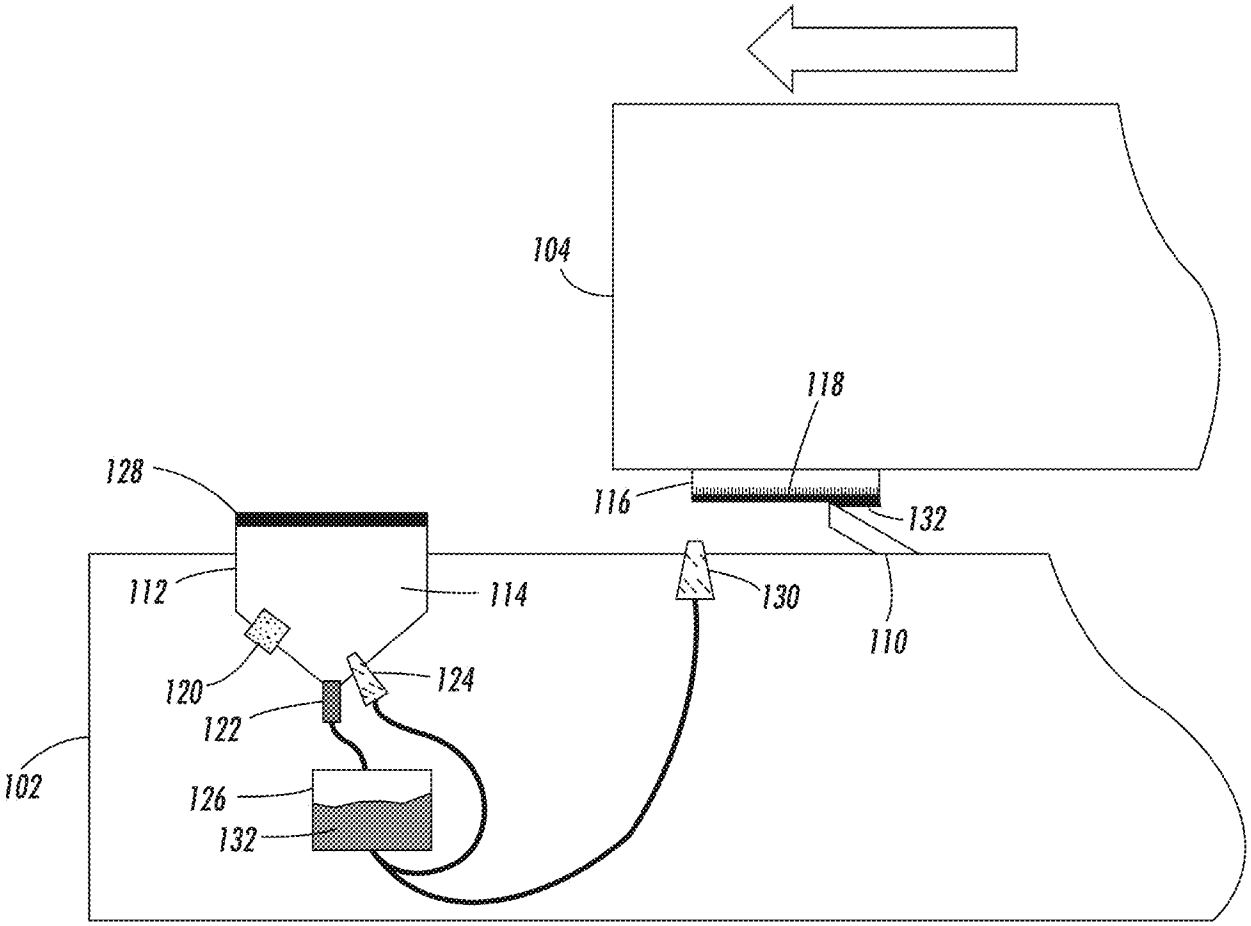

Eventually, the entire printhead 116 moves past the flexible blade 110, which allows the flexible blade to return to the non-folded position shown in FIG. 6. After fully moving past the flexible blade 110, the inkjet print cartridge 104 is then controlled (e.g., by the actuator/track structure 103 discussed above) to reverse direction to move in the opposite direction (in a "second" direction) relative to the cartridge resting structure 102, as shown by the block arrow in the in cross-sectional view shown in FIG. 8. When the inkjet print cartridge 104 is moving in the second direction relative to the cartridge resting structure 102, the flexible blade 110 again contacts of the print head 116 and the flexible blade 110 is adapted to remove excess amounts of the liquid 132 from the nozzles 118, as shown in FIG. 8.

Figure 9:
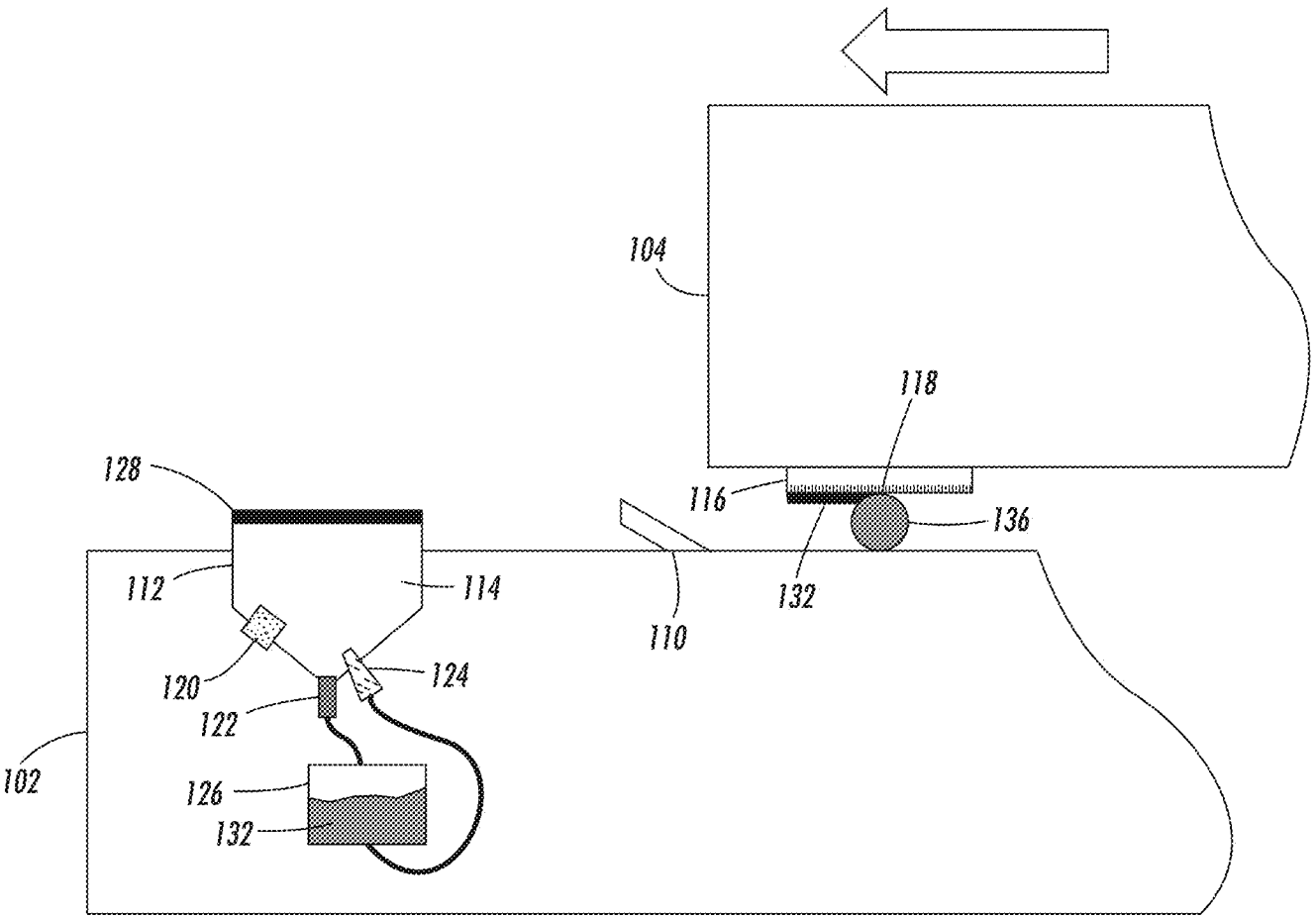
Figure 10:
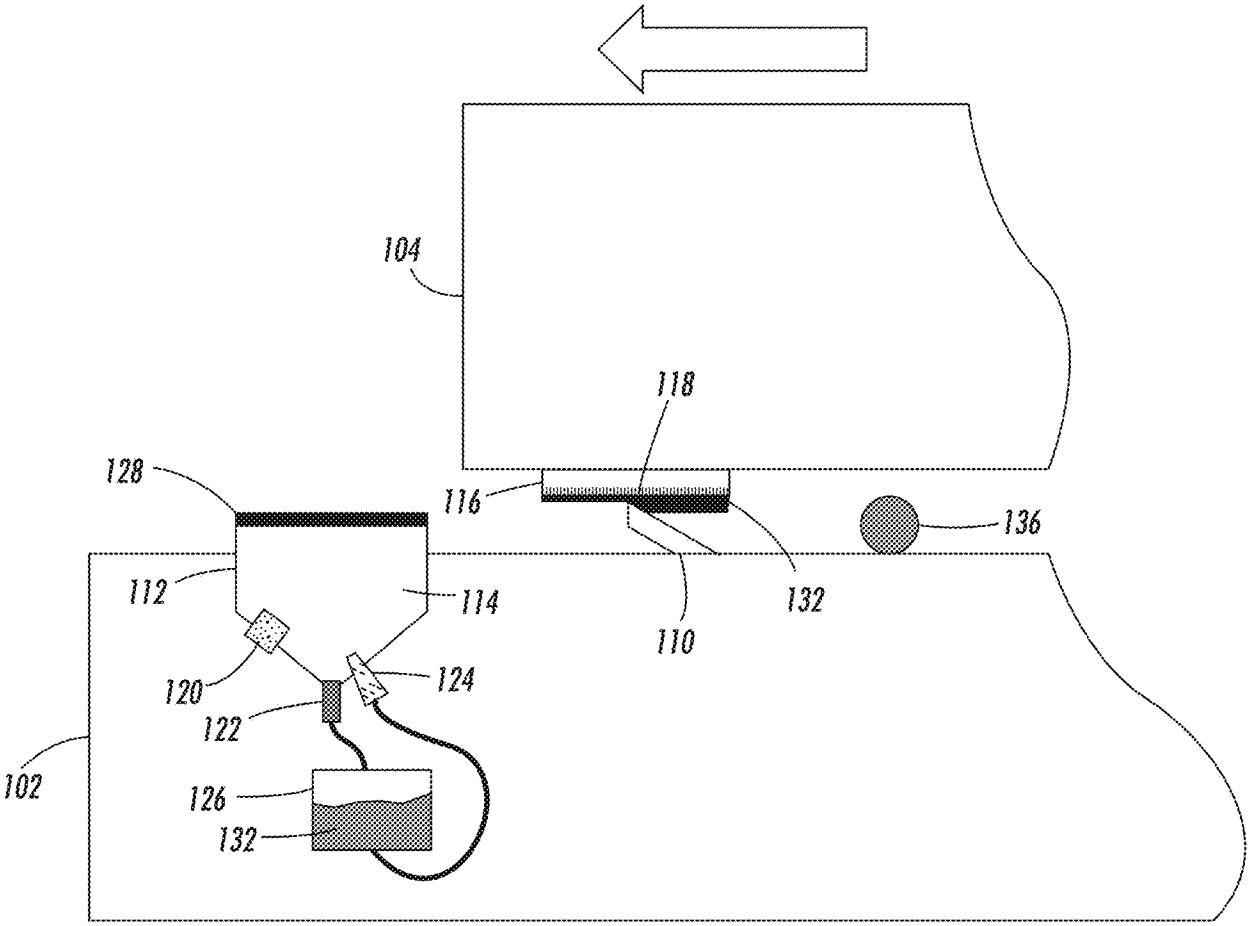

FIGS. 9 and 10 illustrate an alternative structure that utilizes a foam roll 136 impregnated with the liquid 132 to coat the printhead 116 faceplate. Therefore, as shown in FIG. 9, the inkjet print cartridge 104 moves in the aforementioned "second" direction (e.g., toward the cap 112) to allow the foam roll 136 to apply the liquid 132 to the nozzles 118. Then, as shown in FIG. 10, as the inkjet print cartridge 104 continues to move in the second direction, the cleaning blade 110 contacts the printhead 116 to wipe off any excess liquid 132.

Figure 11:
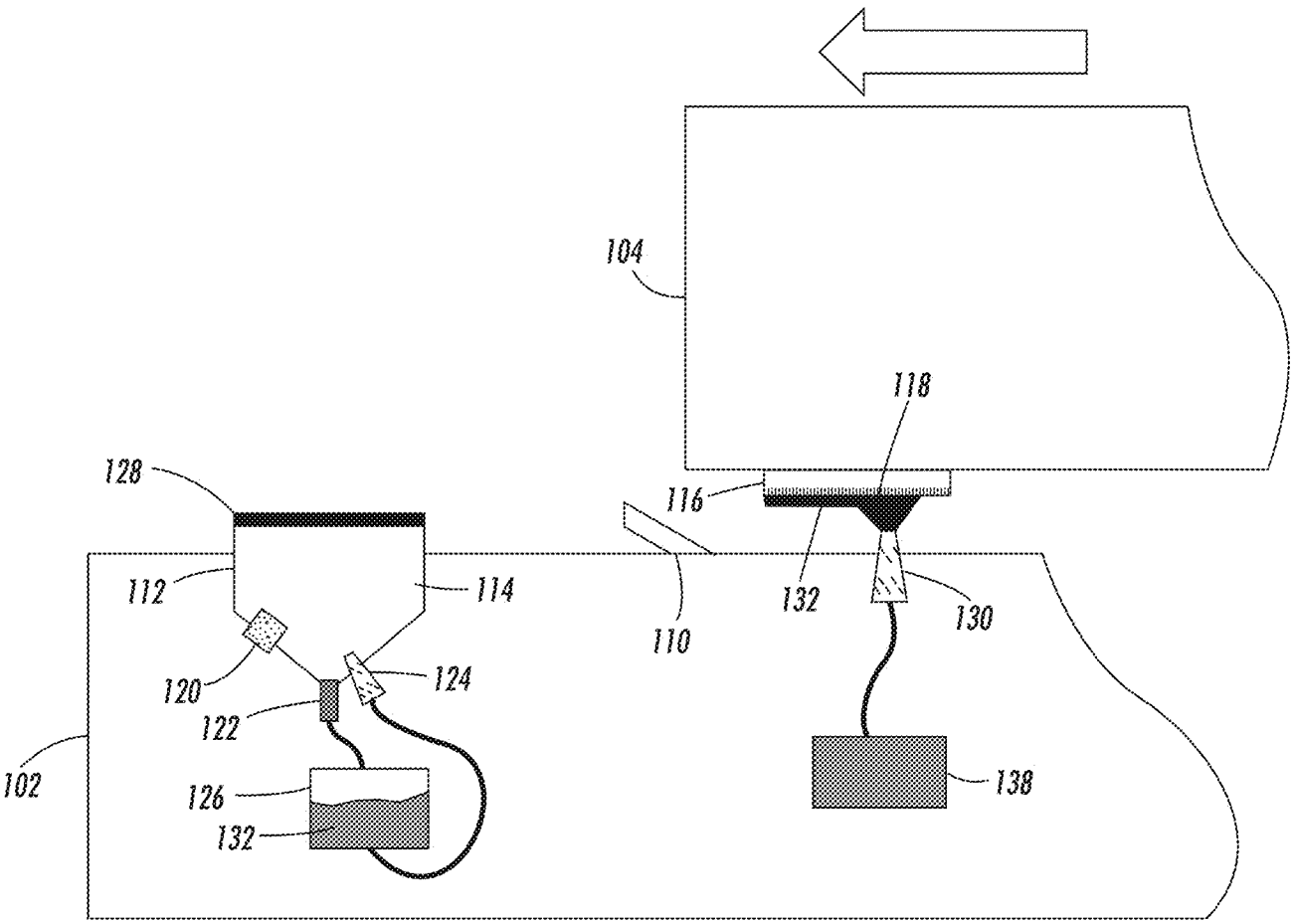
Figure 12:
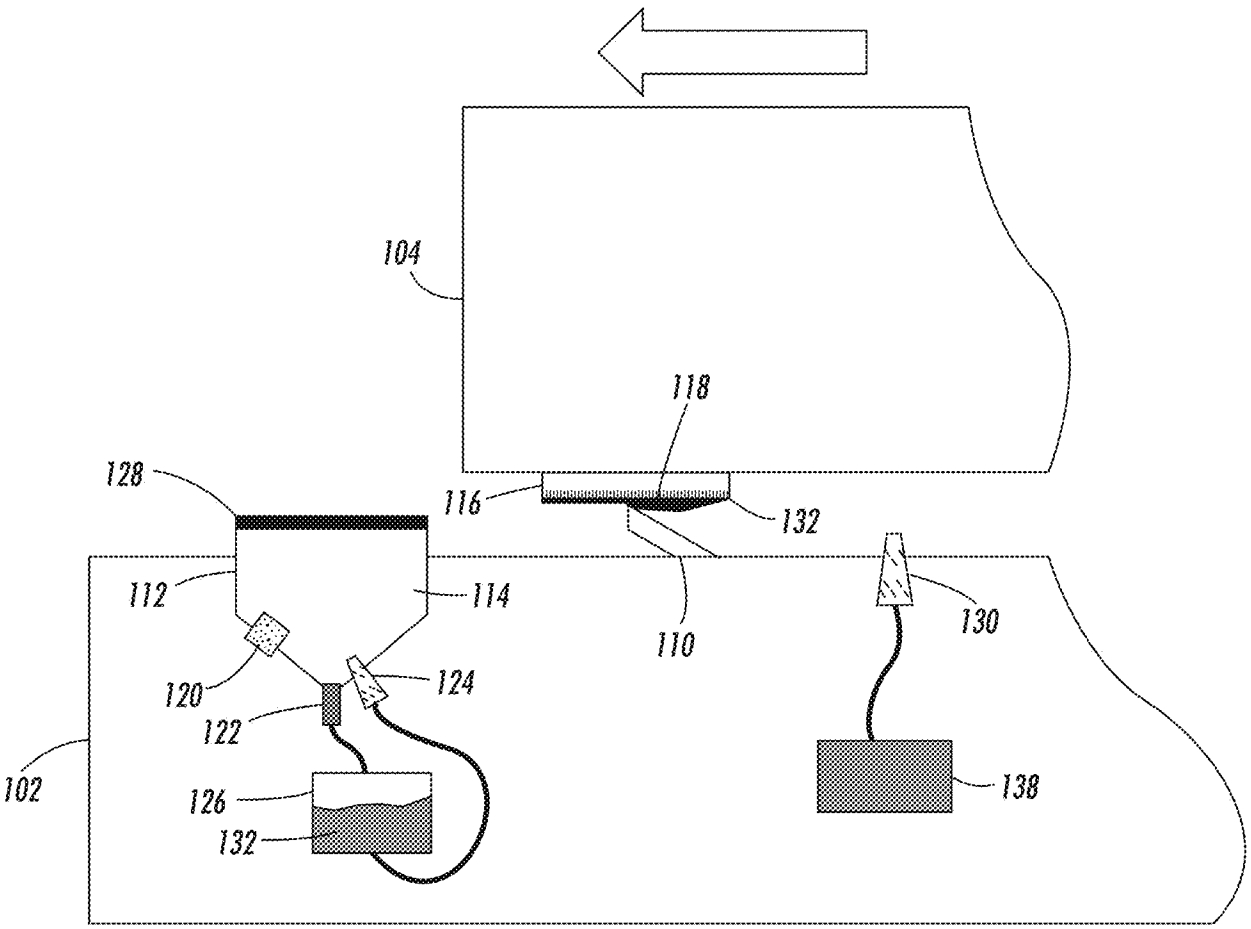

FIGS. 11 and 12 illustrate another structure that utilizes the applicator 130 (e.g., sprayer) to spray a mist of the liquid 132 on the nozzles 118 of printhead 116. Therefore, as shown in FIG. 11, the inkjet print cartridge 104 moves in the second direction toward the cap 112 to allow the applicator 130 to dispense the liquid 132 on the nozzles 118. Then, as shown in FIG. 12, as the inkjet print cartridge 104 continues to move in the second direction, the cleaning blade 110 contacts the printhead 116 to wipe off any excess liquid 132.

FIGS. 11 and 12 also illustrate that the applicator 130 can be supplied the liquid 132 from a different reservoir 138 than the first reservoir 126 discussed above. Therefore, the liquid 132 that is supplied to the humidifier 124 may be different from the liquid that is supplied to the applicator 130 from the second reservoir 138, which allows structures to use different liquids in such different locations based on the liquid's ability to remain in the nozzles 118, its ability to maintain moisture conditions within the sealed space 114, the liquid's compatibility with the ink, etc.

Figure 13:
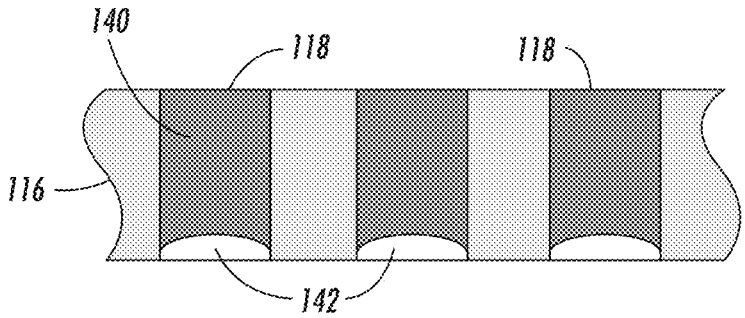
FIGS. 13-15 are cross-sectional conceptual diagrams illustrating nozzles of an inkjet print cartridge of structures herein.
Figure 14:
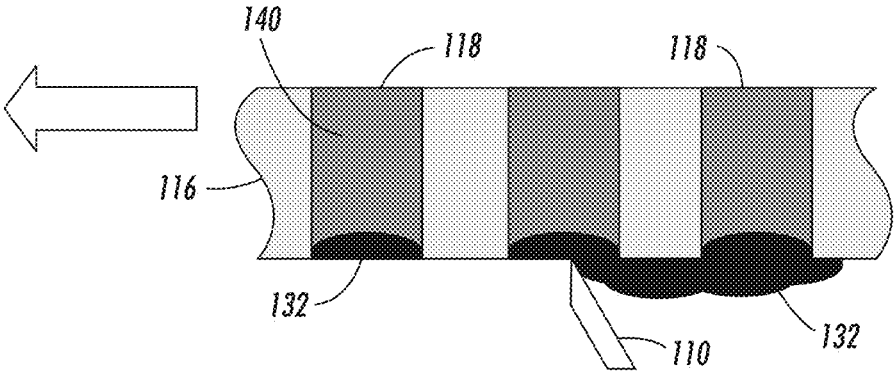
Figure 15:
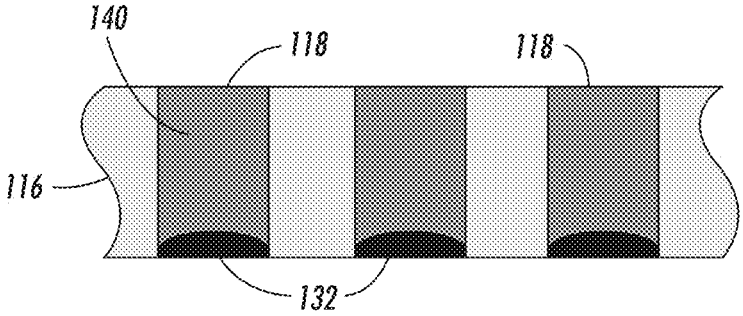

Thus, the foregoing structures are provided to wipe the faceplate of an aqueous printhead 116 with a liquid 132 such as a cleaning solution, and FIGS. 13-15 are cross-sectional conceptual diagrams that show the effect such structures have on a portion of the printhead 116. More specifically, FIGS. 13-15 illustrate a few of the nozzles 118 of a printhead 116. In greater detail, FIG. 13 illustrates liquid ink 140 within the nozzles 118. Note that the liquid ink 140 can be drawn into the ends of the nozzles 118 (nozzle openings) resulting from retraction of ejectors or because of surface tension forces, leaving rounded recesses 142 (empty spaces) at the ends of the nozzles 118.

FIG. 14 includes a block arrow to illustrate the movement of the inkjet print cartridge 104 across the flexible blade 110 when the flexible blade 110 is wiping the excess amount of liquid 132 from the print head 116. FIG. 14 also illustrates that the flexible blade 110 allows in the liquid 132 to remain within the recesses 142 at the ends of the nozzles 118. FIG. 15 illustrates that after the liquid 132 is drawn into the recesses 142 (or is forced into the recesses 142 by the flexible blade 110), the liquid 132 remains within the recesses 142 at the ends of the nozzles 118 because of negative head pressure resulting from surface tension of liquid 132 and/or the shape of the recess 142. After the liquid 132 is positioned in the recesses 142, the printhead 116 is parked on the cap 112 (as shown in FIG. 2, for example), at which point the humidifier 124 system may be optionally activated.

As noted above, the liquid 132 can be any liquid that is compatible with the liquid ink 140. Therefore, the liquid 132 can be water or any printhead cleaning fluid. Further, with embodiments herein, the liquid 132 is selected to have a low vapor pressure that will prevent/slow evaporation of the liquid 132 and allow the liquid 132 to remain in the nozzles 118 until purged away. During purging, for example, at the beginning of each print cycles (e.g., each time the inkjet print cartridges 104 are moved away from the cartridge resting structure 102) a brief purge cycle can be performed during which the liquid 132 and any ink 140 in the ends of the nozzles 118 are evacuated from the nozzles 118 to allow only fresh ink to be utilized during printing operations.

As noted previously, with these structures, the recesses 142 at the ends of the nozzles 118 are filled with liquid 132 to prevent the ink from drying. However, the presence of the liquid 132 in the recesses 142 not only prevents ink from drying but can also dissolve any previous ink that has dried, and thereby re-solubilizes any dried ink that has previously accumulated in the nozzles.

Further, by optionally combining the blade-based liquid application structures shown in FIGS. 5-15 with use of the cap 112 that includes the humidifier 124 (that varies the supply of the moisture 108 to the sealed space 114, potentially based on the amount of moisture 108 detected by the moisture sensor 120) shown in FIGS. 1-4, the liquid 132 within the recesses 142 is further prevented from drying out, thereby extending the useful life of the liquid 132 within the recesses 142. Otherwise, if the cap/humidifier 112/124 system is not used, the recesses 142 can be periodically refreshed (refilled) with the liquid 132 by periodically cycling the application process (e.g., passing the printhead 116 over the application structures 110, 130, 136, etc.) as needed based on expected evaporation of the liquid 132 from the recesses 142. Thus, the combination of these structures reduces the frequency with which the liquid 132 is applied to the recesses 142 at the ends of the nozzles 118 (reduces the number of liquid 132 application cycles). Reducing the number of liquid 132 application cycles reduces the amount of liquid 132 consumed, and also reduces wear and tear on the actuator/track structure 103, the flexible blade 110, the applicators 130, 136, etc., that would otherwise be utilized during each application cycle.

Further, by first applying the liquid 132 to the recesses 142 within the ends of the nozzles 118 before resting the printhead 116 on the cap 112, the amount of moisture 108 maintained within the sealed space 114 can be reduced, thereby reducing the amount of liquid 132 that is used by these systems (and reducing wear on the humidifier 124, etc.). Therefore, such structures are highly useful because they keep ink from drying in the nozzles and can even remove dried ink that has previously accumulated in the nozzles.

Figure 16:
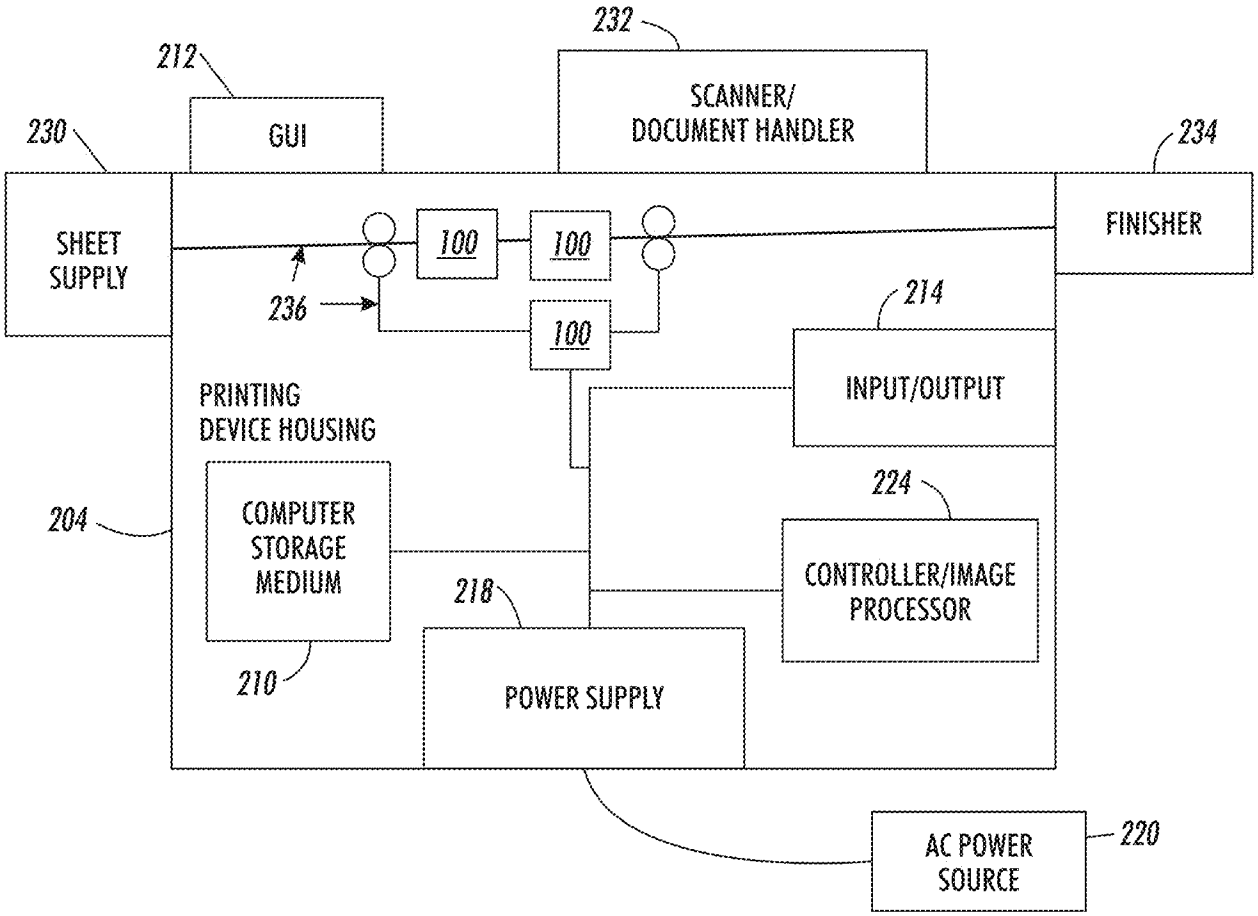
FIG. 16 is a conceptual diagram illustrating printing devices herein.

FIG. 16 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 16, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 100 that use marking material, and are operatively connected to a specialized image processor 224 (that may be different from a general purpose computer because it is specialized for processing image data), a media path 236 positioned to supply continuous media or sheets of media from a sheet supply 230 to the marking device(s) 100, etc. After receiving various markings from the printing engine(s) 100, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 100 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 100 can include, for example, inkjet printheads, contact printheads, three-dimensional printers, etc.

As noted above, the moisture/humidity level in the sealed space 114 can be maintained at different levels for different printheads, different inks, different colors, different print bars, etc. When printheads, inks, colors, etc., are installed in a printer, the controller 224 is made aware of the printer's components. Therefore, the controller 224 can control the humidifier 124 to: supply different amounts of moisture 108 to the different color printheads 116 within the printer; supply specific amounts of moisture 108 to the types of printheads 116 used within the printer; supply moisture 108 to the sealed space 114 only after an idle time period that is specific to the ink or printheads within the printer has expired, etc.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a printhead comprising nozzles adapted to eject liquid ink;

a cap positioned to contact the printhead when the printhead is not ejecting the liquid ink, wherein the cap and the printhead create a sealed space adjacent the nozzles when contacting each other;

a humidifier connected to the cap and adapted to supply a moisture to the sealed space; and a controller connected to the humidifier adapted to control the humidifier to supply different amounts of the moisture to different color printheads, wherein the humidifier comprises an atomizer adapted to form fine droplets of the moisture in the sealed space and to avoid spraying the moisture directly on the nozzles.

2. The apparatus according to claim 1, wherein the controller is adapted to control the humidifier to supply the moisture to the sealed space only after an idle time period, during which the nozzles do not eject the liquid ink, has expired.

3. The apparatus according to claim 1, wherein the cap comprises a drain adapted to remove condensation of the moisture from the sealed space.

4. The apparatus according to claim 1, further comprising a reservoir operatively connected to the humidifier and adapted to supply a liquid solution that forms the moisture to the humidifier.

5. An apparatus comprising:

a printhead comprising nozzles adapted to eject liquid ink;

a cap positioned to contact the printhead when the printhead is not ejecting the liquid ink, wherein the cap and the printhead create a sealed space adjacent the nozzles when contacting each other;

a humidifier connected to the cap and adapted to supply a moisture to the sealed space; and a moisture sensor connected to the cap; and a controller connected to the humidifier adapted to control the humidifier to supply different amounts of the moisture to different color printheads, wherein the moisture sensor is adapted to detect an amount of the moisture in the sealed space, and wherein the humidifier is adapted to vary supply of the moisture to the sealed space based on the amount of moisture detected by the moisture sensor, wherein the humidifier comprises an atomizer adapted to form fine droplets of the moisture in the sealed space and to avoid spraying the moisture directly on the nozzles.

6. The apparatus according to claim 5, wherein the controller is adapted to control the humidifier to supply the moisture to the sealed space only after an idle time period, during which the nozzles do not eject the liquid ink, has expired.

7. The apparatus according to claim 5, wherein the cap comprises a drain adapted to remove condensation of the moisture from the sealed space.

8. The apparatus according to claim 5, further comprising a reservoir operatively connected to the humidifier and adapted to supply a liquid solution that forms the moisture to the humidifier.

9. An apparatus comprising:

a printhead comprising nozzles adapted to eject liquid ink;

a cap positioned to contact the printhead when the printhead is not ejecting the liquid ink, wherein the cap and the printhead create a sealed space adjacent the nozzles when contacting each other;

a flexible blade positioned to contact the printhead when the printhead is not in contact with the cap, wherein the flexible blade is adapted to fold over to spread a liquid solution on the nozzles in a first direction, and wherein the flexible blade is adapted to remove excess amounts of the liquid solution from the nozzles in a second direction;

a humidifier connected to the cap and adapted to supply a moisture form of the liquid solution to the sealed space;

a moisture sensor connected to the cap; and a controller connected to the humidifier adapted to control the humidifier to supply different amounts of the moisture to different color printheads, wherein the moisture sensor is adapted to detect an amount of the moisture in the sealed space, and wherein the humidifier is adapted to vary supply of the moisture to the sealed space based on the amount of moisture detected by the moisture sensor, wherein the humidifier comprises an atomizer adapted to form fine droplets of the moisture in the sealed space.

10. The apparatus according to claim 9, wherein the controller is adapted to control the humidifier to supply the moisture to the sealed space only after an idle time period, during which the nozzles do not eject the liquid ink, has expired.

11. The apparatus according to claim 9, wherein the humidifier is to avoid spraying the moisture directly on the nozzles.

12. The apparatus according to claim 9, wherein the cap comprises a drain adapted to remove condensation of the moisture from the sealed space.

* * * * *